US005253872A

United States Patent [19]

Lemons et al.

[11] Patent Number: 5,253,872

[45] Date of Patent: Oct. 19, 1993

[54] GOLF BALL

[75] Inventors: Lane D. Lemons, Fort Worth, Tex.; John W. Jepson, Naples, Fla.

[73] Assignee: Ben Hogan Co., Richmond, Va.

[21] Appl. No.: 805,595

[22] Filed: Dec. 11, 1991

[51] Int. Cl.[5] ..... A63B 37/14

[52] U.S. Cl. ..... 273/232; 40/327

[58] Field of Search ..... 273/232, 220; 40/327

[56] References Cited

U.S. PATENT DOCUMENTS

| | | | |
|---|---|---|---|
| 4,560,168 | 12/1985 | Aoyama | 273/232 |
| 4,720,111 | 1/1988 | Yamada | 273/232 |
| 4,762,326 | 8/1988 | Gobush | 273/232 |
| 4,765,626 | 8/1988 | Gobush | 273/232 |
| 4,772,026 | 9/1988 | Gobush | 273/232 |
| 4,813,677 | 3/1989 | Oka et al. | 273/232 |
| 4,844,472 | 7/1989 | Ihara | 273/232 |
| 4,867,459 | 9/1989 | Ihara | 273/232 |
| 4,869,512 | 9/1989 | Nomura et al. | 273/232 |
| 4,877,252 | 10/1989 | Shaw | 273/232 |
| 4,880,241 | 11/1989 | Melvin et al. | 273/232 |
| 4,886,277 | 12/1989 | Mackey | 273/232 |
| 4,915,389 | 4/1990 | Ihara | 273/232 |
| 4,915,390 | 4/1990 | Gobush et al. | 273/232 |
| 4,925,193 | 5/1990 | Melvin et al. | 273/232 |
| 4,932,664 | 6/1990 | Bocklington et al. | 273/232 |
| 4,936,587 | 6/1990 | Lynch et al. | 273/232 |
| 4,946,167 | 8/1990 | Yamada | 273/232 |
| 4,948,143 | 8/1990 | Aoyama | 273/232 |
| 4,971,330 | 11/1990 | Morell | 273/232 |
| 4,973,057 | 11/1990 | Morell | 273/232 |
| 4,974,853 | 12/1990 | Morell | 273/232 |
| 4,974,854 | 12/1990 | Morell | 273/232 |
| 4,974,855 | 12/1990 | Morell | 273/232 |
| 4,974,856 | 12/1990 | Morell | 273/232 |
| 4,979,747 | 12/1990 | Jonkouski | 273/232 |
| 4,982,964 | 1/1991 | Morell | 273/232 |
| 4,998,733 | 3/1991 | Lee | 273/232 |
| 5,003,750 | 7/1991 | Yamagishi et al. | 273/232 |
| 5,009,427 | 4/1991 | Stiefel et al. | 273/232 |
| 5,009,428 | 4/1991 | Yamagishi et al. | 273/232 |
| 5,046,742 | 9/1991 | Mackey | 273/232 |

*Primary Examiner*—George J. Marlo

[57] ABSTRACT

An arrangement for dimples on the surface of a golf ball is disclosed. The golf ball surface is subdivided by projecting a tetrakaidecahedron onto the surface thereof. Dimples are arranged according to the location of the hexagons and trapezoids which comprise the tetrakaidecahedron. The hexagons and trapezoids can also be divided into triangles by inclusion of diagonals therein. With the inclusion of diagonals, up to ten great circle paths can be defined and the dimples can be arranged so that they do not intersect any of the great circle paths.

17 Claims, 8 Drawing Sheets

GOLF BALL

FIELD OF THE INVENTION

The present invention relates to golf balls and, more particularly, to the arrangement of dimples on the surface of a golf ball.

BACKGROUND OF THE INVENTION

Until about the early 1970's, virtually all golf balls in the modern era had their dimple layout based on an octahedron projected onto the surface of the golf ball. An octahedron is an eight-sided figure which, when projected onto a golf ball surface, divides the surface into eight equal spherical triangular sections. If the dimples on the golf ball are confined in these eight sections, as was the practice in the golf industry, the golf ball has three "parting lines," i.e. great circles which pass about the golf ball and are not intersected by any dimples.

The term "parting line" emanates from the fact that spherical objects, such as golf balls, must be made in multi-piece molds. Golf balls are typically made in two hemispherical molds, by either compression or injection molding. No matter which type of molding is used, there is a junction between the two molds at which "flash" forms. When the molds are parted, this flash is called the "parting line." The flash is typically buffed off so that the parting line becomes essentially invisible. It will be appreciated, however, that, since a dimple is a depression in the surface of the golf ball, it is very difficult, if not impossible, to buff the flash out of a dimple without destroying the land area between adjacent dimples. Therefore, golf ball makers virtually always make the parting line free of dimples. As discussed hereinafter, some golf balls, either for aerodynamic or aesthetic reasons, have more than one great circle path which is not intersected by any dimples. Any one of the great circle paths not intersected by dimples can be the actual mold parting line. However, as used herein, the term "parting line" means any great circle path which is not intersected by any dimples, i.e. the term "parting line" as used herein is not limited to the flash line created by the hemispherical molds used to form a golf ball.

In a golf ball derived from an octahedron, there are three parting lines and the three parting lines cross each other at right angles; as a result, the included angle of the corners of each of the eight spherical triangles of an octahedron projected onto a golf ball is a right angle. It will be appreciated that, while the three included angles of a two-dimensional triangle will always total exactly 180°, the three included angles of a spherical triangle, i.e. a triangle on the surface of a sphere, will always exceed 180° and, with the octahedron layout, will total 270°.

The planar/spherical relationship holds true for other geometric shapes, e.g. squares, pentagons, hexagons, etc. While, for example, a planar square will always total 360°, a spherical square will always exceed 360°. Since the present invention relates to golf balls, which are spheres, it will be understood that where a term such as "square", "triangle", or the like is used when referring to the surface of the golf ball, it always means the spherical square, spherical triangle, etc.

In the early 1970's, some golf ball manufacturers moved away from the octahedron as the basic pattern and adopted the icosahedron, a layout which has one parting line. In ensuing years, others have adopted and modified the icosahedron layout on the surface of a golf ball to obtain different dimple arrangements. U.S. patents which use the icosahedron as the basis for the dimple arrangement include, for example, U.S. Pat. Nos. 4,560,168; 4,844,472; 4,880,241; 4,925,193; 4,936,587; and 5,009,427.

Other geometric patterns besides the icosahedron have also been used for arranging the dimples on the surface of the golf ball, primarily to create more parting lines. The primary advantages of having more than one parting line are aerodynamics and aesthetics. With respect to aerodynamics, the United States Golf Association (USGA) adopted a rule in the early 1980's that requires that a golf ball "perform in general as if it were spherically symmetrical." The USGA set up testing procedures at its facilities in Far Hills, New Jersey, to ensure that golf balls met this spherical symmetry standard. Some of the golf balls with an icosahedron layout, which had a single parting line and uniformly shaped dimples, did not pass the USGA symmetry tests and were, therefore, not on the USGA list of Conforming Golf Balls. Since virtually all golfers, including professional, amateur and hacker, will only play with golf balls approved by the USGA, failure of a golf ball to be on the USGA list of Conforming Golf Balls is a golf ball's kiss of death. Golf balls having multiple parting lines are generally spherically symmetrical and, to the best of the knowledge of the applicant, no golf ball with three or more parting lines and uniformly shaped dimples has ever failed to pass the USGA spherical symmetry test.

With respect to the aesthetic aspect, a single parting line can be a distraction to a golfer, especially if it has writing such as a trademark thereon. As is known, golfers tend to be very intense when striking a golf ball. By having multiple parting lines, the distraction of a single band around the ball is eliminated.

It will be appreciated, of course, that golf balls can be made with a single parting line which will pass the USGA spherical symmetry test. Such balls can be made with the parting line substantially inconspicuous if the trademarks or other indicia are applied randomly rather than on the parting line.

One of the more popular of the other geometric patterns has been the cube. U.S. patents which arrange dimples on the surface of a golf ball on the basis of a cube or a modification of a cube or derivation from a cube include U.S. Pat. Nos. 4,772,026; 4,971,330; 4,973,057; 4,974,853; 4,974,855; 4,974,856; and 4,982,964.

There have also been various other geometric shapes which have been used for arranging the dimples on the surface of a golf ball. Among these are the cuboctahedron, U.S. Pat. No. 4,762,326; modified octahedron, U.S. Pat. No. 4,948,143; truncated octahedron, U.S. Pat. No. 4,765,626; hexaoctahedron, U.S. Pat. No. 4,974,854; decahedron, U.S. Pat. No. 4,998,733; and dodecahedron, U.S. Pat. No. 4,877,252.

In addition to those patents which arrange dimples on the surface of a golf ball according to a polyhedron, there are also U.S. patents which use combinations of various geometric shapes but without drawing the dimple arrangement from a specific polyhedron. For example, U.S. Pat. No. 4,886,277 arranges six squares and eight hexagons on the surface of a golf ball and arranges the dimples according to the layout of the squares and hexagons. U.S. Pat. No. 5,046,742 is similar to the foregoing patent except that it uses twelve pentagons and twenty hexagons to establish the dimple arrangement. Similarly, U.S. Pat. No. 4,932,664 uses two pentagons, ten trapezoids and ten triangles.

A number of the foregoing patents teach that the dimples can be arranged on the surface of the golf ball so that there are a plurality of parting lines, i.e. great circle paths which are not intersected by any dimples. As described in the prior art, the number of parting lines which can be obtained with basic geometric arrangements includes: one, U.S. Pat. Nos. 4,813,677; 4,915,390; 4,925,193; 4,932,664; three, U.S. Pat. Nos. 4,720,111; 4,765,626; 4,946,167; 5,009,428; 5,033,750; four, U.S. Pat. Nos. 4,886,277; 4,948,143; 4,973,057; 4,979,747; six, U.S. Pat. Nos. 4,560,168; 4,772,026; 4,982,964; seven, U.S. Pat. Nos. 4,762,326; 4,869,512; 4,974,856; nine, U.S. Pat. Nos. 4,869,512 and 4,974,855; ten, U.S. Pat. No. 4,971,330; twelve, U.S. Pat. No. 4,974,854; thirteen, U.S. Pat. No. 4,974,853; fifteen, U.S. Pat. No. 4,844,472; twenty-one, U.S. Pat. No. 4,867,459; twenty-five, U.S. Pat. No. 4,867,459; and thirty-one, U.S. Pat. No. 4,867,459. While these many different types of possible parting lines are disclosed, some of the patents also teach that dimples can intersect one or more of the parting lines, see for example U.S. Pat. Nos. 4,974,856 and 4,982,964. Indeed, one patent, U.S. Pat. No. 4,915,389, requires that all dimples intersect great circle paths on the surface of the golf ball.

SUMMARY OF THE INVENTION

The present invention describes a novel manner in which dimples can be symmetrically arranged on the surface of a golf ball. In accordance with the present invention, dimples are arranged on the surface of a golf ball based on the geometry of a tetrakaidecahedron. A tetrakaidecahedron is a fourteen-sided geometrical solid which, when projected onto the surface of a golf ball, has hexagons at opposed poles of the golf ball with the pole serving as the center of the hexagons. Between each polar hexagon and the equator of the golf ball there are six trapezoids, i.e. there are a total of twelve trapezoids between the two polar hexagons and the equator of the golf ball. The hexagons and trapezoids can be divided by placing diagonals therein. If each hexagon and trapezoid is divided by its diagonals, lines connecting the diagonals and the sides of the hexagons and trapezoids can be connected to form a total of ten great circle paths. All of these great circle paths can serve as parting lines i.e. not be intersected by any dimples, or some of them can serve as parting lines and others can be intersected by dimples.

DETAILED DESCRIPTION OF THE DRAWINGS

Figure 1:
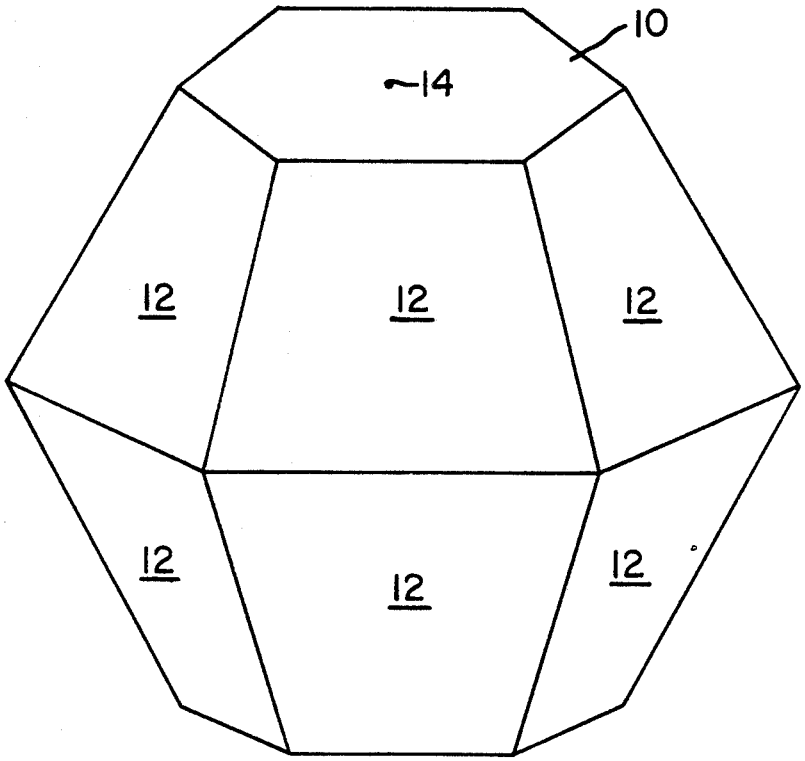
FIG. 1 is a tetrakaidecahedron.

Referring first to FIG. 1, there is shown a typical tetrakaidecahedron comprising hexagon 10 and trapezoids 12. As will be appreciated, there is a second hexagon at the bottom of the tetrakaidecahedron opposite the hexagon 10 and there are six additional trapezoids on the back side of the tetrakaidecahedron opposite the six trapezoids shown. Hexagon 10 has as its center point 14.

Figure 2:
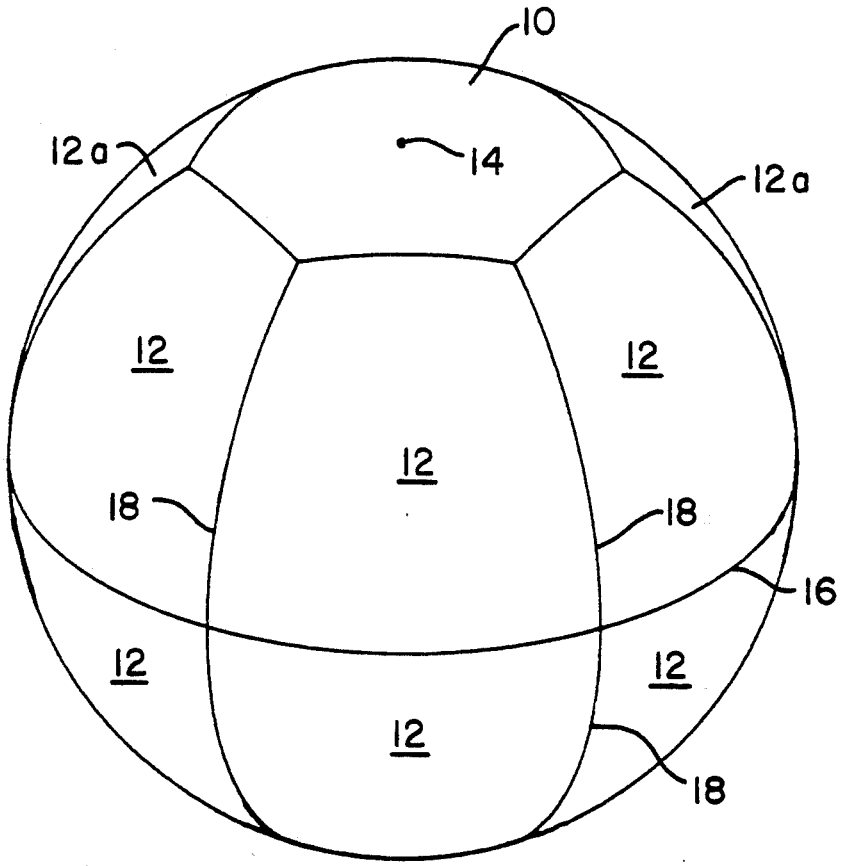
FIG. 2 shows the tetrakaidecahedron of FIG. 1 projected onto the surface of a golf ball.

Referring now to FIG. 2, there is shown the tetrakaidecahedron of FIG. 1 projected onto the surface of a golf ball. For ease of understanding, the same numerals 10, 12 and 14 have been used to refer to the hexagon and trapezoids projected from FIG. 1 onto FIG. 2. As can be seen, however, there are portions of additional trapezoids 12*a* which are visible in FIG. 2. This is because of the nature of spherical geometry.

Referring to hexagon 10, point 14 is at the center thereof. In golf ball language, center point 14 is referred to as the pole of the golf ball. The opposite pole of the golf ball serves as the center point for the other hexagon (not shown). The equator 16 of the golf ball is a great circle which has as its axis a line which intersects the surface of the golf ball at poles 14. The trapezoids 12 are positioned between the hexagon 10 and the equator 16. One side of the hexagon 10 serves as the top of each trapezoid and a section of equator 16 serves as the base of each trapezoid. The hexagon is a regular hexagon and the equator is divided into six equal segments; as a result, the twelve trapezoids are all of the same size. In addition, the sides 18 of the trapezoid, each of which extends from a vertex of the hexagon to the equator, are all of equal length so that the twelve trapezoids 12 have the shape of a truncated isosceles triangle and are all of the same size.

Figure 3:
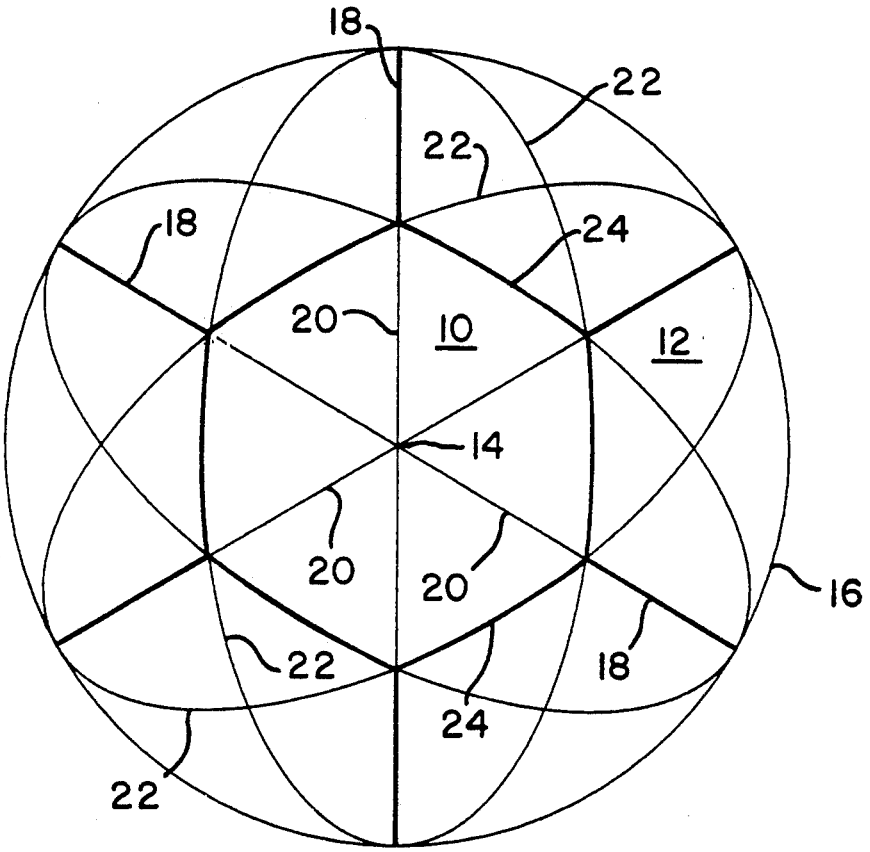
FIG. 3 shows the golf ball of FIG. 2 rotated to have one of the polar hexagons as a front view and further shows diagonals bisecting each of the hexagons and trapezoids.

Turning now to FIG. 3, there is shown the arrangement of FIG. 2 in which the hexagon 10 has been rotated to be viewed from the front. In addition to rotation of the golf ball, diagonals have been added to the hexagon and to each of the trapezoids to subdivide them. Diagonals 20 subdivide the hexagon into triangles, and diagonals 22 subdivide the trapezoids into triangles. As can be seen, all six sides 24 of the hexagon form great circle paths with adjacent diagonals 22 of the trapezoids 12. Additionally, the three diagonals 20 of the hexagon 10 form great circle paths with the sides 18 of the trapezoids. Since equator 16 is also a great circle path, there are ten great circle paths shown in FIG. 3. As will be appreciated from FIG. 3, the length of the sides 24 of the hexagon is of no moment. If the length of the sides the hexagon is changed, it will obviously change the size of the triangles within both the hexagon and the trapezoids.

Figure 4:
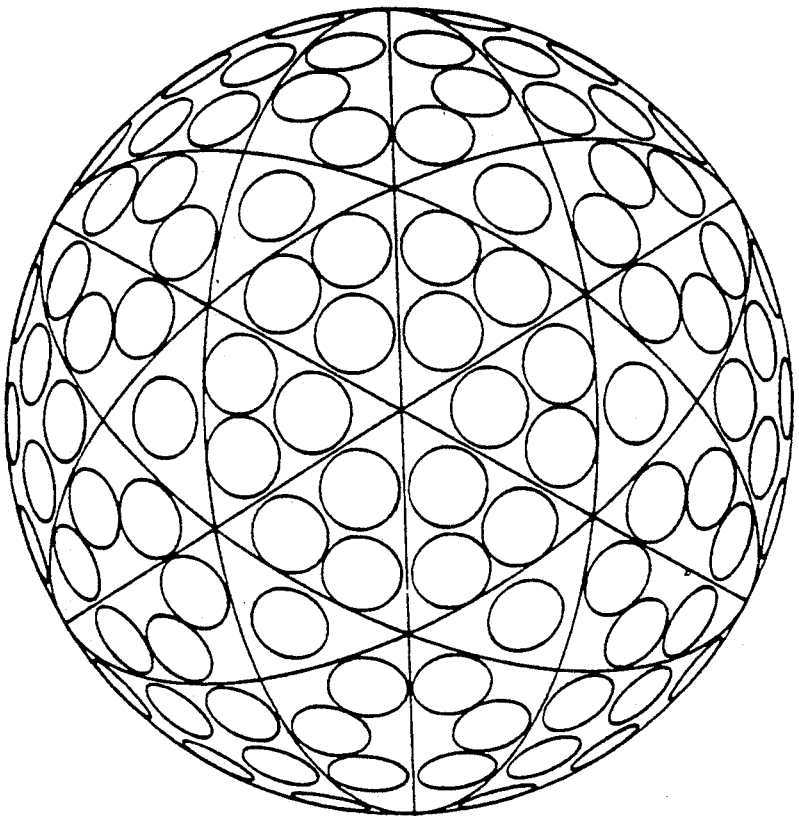
FIG. 4 shows an arrangement of dimples in the pattern of FIG. 3 with ten parting lines.

Turning now to FIG. 4, there is shown the placement of dimples in the various triangles formed by the subdivision of the tetrakaidecahedron as shown in FIG. 3. FIG. 4 illustrates the situation in which none of the dimples intersect any one of the great circle paths, i.e. each one of the ten great circle paths is a parting line. It is to be understood that the dimple arrangement in FIG. 4 is illustrative of having no dimples intersect the great circle paths and that the number of dimples in each triangle could be substantially different from the number shown. For example, the triangles formed by the dimples of the hexagon could contain six or ten dimples in "bowling pin" fashion similar to the three dimples in "bowling pin" fashion shown in FIG. 4. It will also be understood that dimples of varying sizes and shapes can be employed in accordance with the present invention. Myriad patterns, sizes and shapes of dimples for both those within the triangles of the hexagons and those within the triangles of the trapezoids will also be readily apparent to those of ordinary skill in the art.

Figure 5:
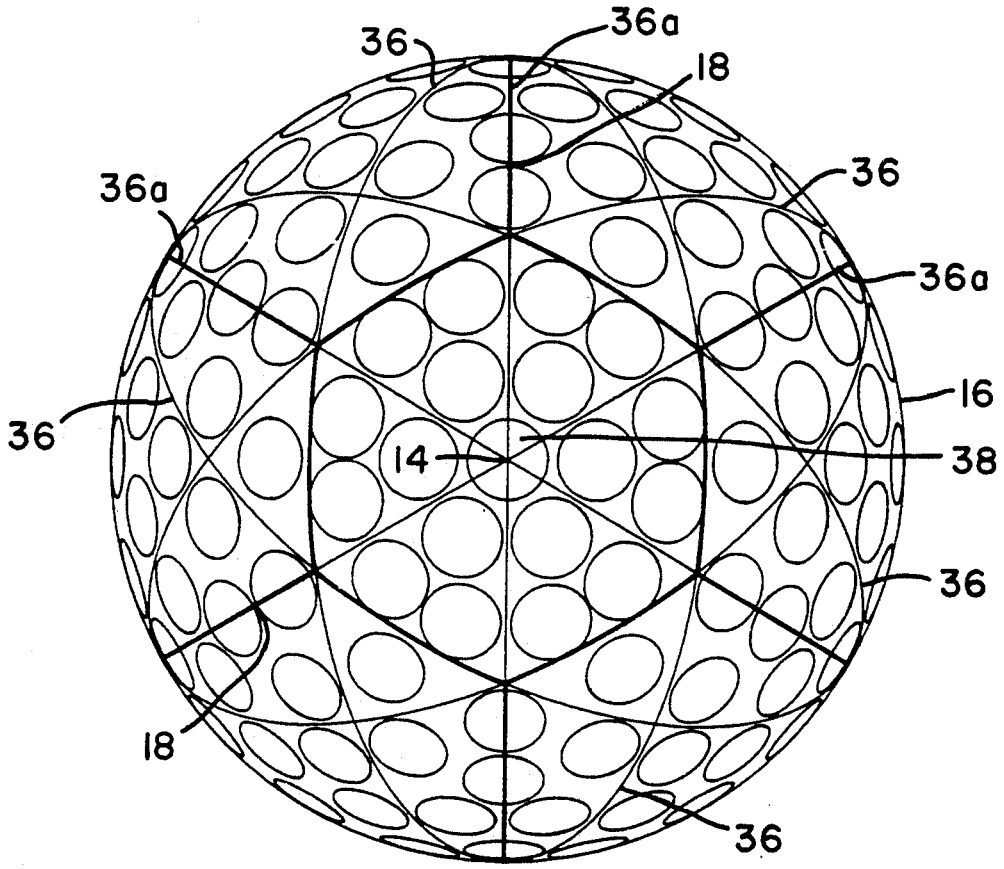
FIG. 5 shows an arrangement of dimples in the pattern of FIG. 3 with seven parting lines.

FIG. 5 is an arrangement of dimples wherein some dimples intersect some of the great circle paths. In this figure, the great circle paths are designated as 36 and 36*a*. As can be seen, dimple 38 has as its center point the center point 14 of the hexagon. Dimple 38 intersects the three great circle paths 36*a* which pass through point 14. As can also be seen in FIG. 5, each of the sides 18 of trapezoids 12 is intersected by three dimples. In the embodiment shown in FIG. 5, the intersecting dimples are bisected by the sides 18 of the trapezoid. The intersection by dimples of the great circle paths 36*a* leaves the six great circle paths 36 and the equator great circle path 16 as parting lines, i.e. great circle paths which are not intersected by any dimples. It is to be noted that each of the great circle paths 36 includes a side of the hexagon. Since great circle paths 36 are parting lines, this means, as shown, that no dimples intersect the sides of the hexagon.

Figure 6:
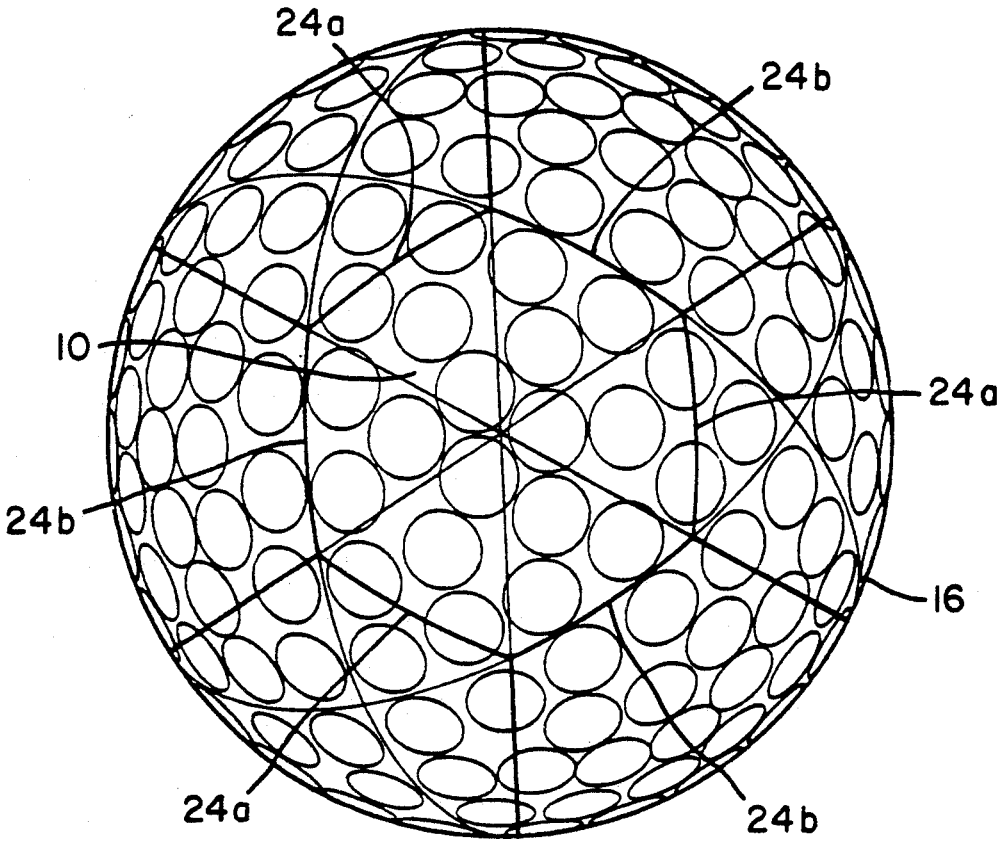
FIG. 6 shows an arrangement of dimples in the pattern of FIG. 3 with four parting lines.

In the embodiment illustrated in FIG. 6, three of the great circle paths are intersected by dimples as shown in FIG. 5 and, in addition, three more great circle paths are intersected by dimples. The second set of three great circle paths intersected by dimples includes alternate sides of the hexagons 10. The great circle paths which include hexagon sides 24*a* are intersected by dimples while the great circle paths which include hexagon sides 24*b* are not intersected by any dimples. The three great circle paths including sides 24*b* and the equator great circle path 16 make a total of four parting lines in the embodiment of FIG. 6.

Figure 7:
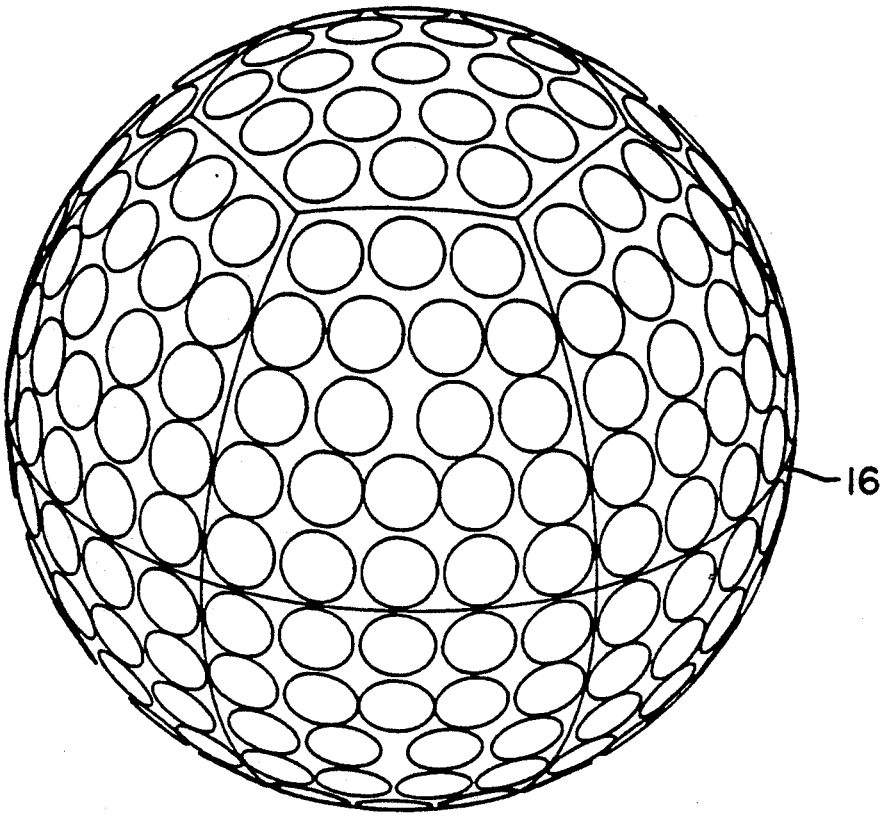
FIG. 7 shows an arrangement of dimples in the pattern FIG. 3 with one parting line.

The dimple arrangement in FIG. 7 employs the basic tetrakaidecahedron projected onto a golf ball as shown in FIG. 2. In this instance, the only great circle path which is not intersected by any dimples is the equator great circle path 16. As shown, however, and as preferred, none of the dimples intersect any of the sides of the trapezoids or the hexagon. It will be noted that since the dimples do not intersect the sides of the hexagon or the equator, they inherently cannot intersect the base and top of the trapezoid.

Figure 8:
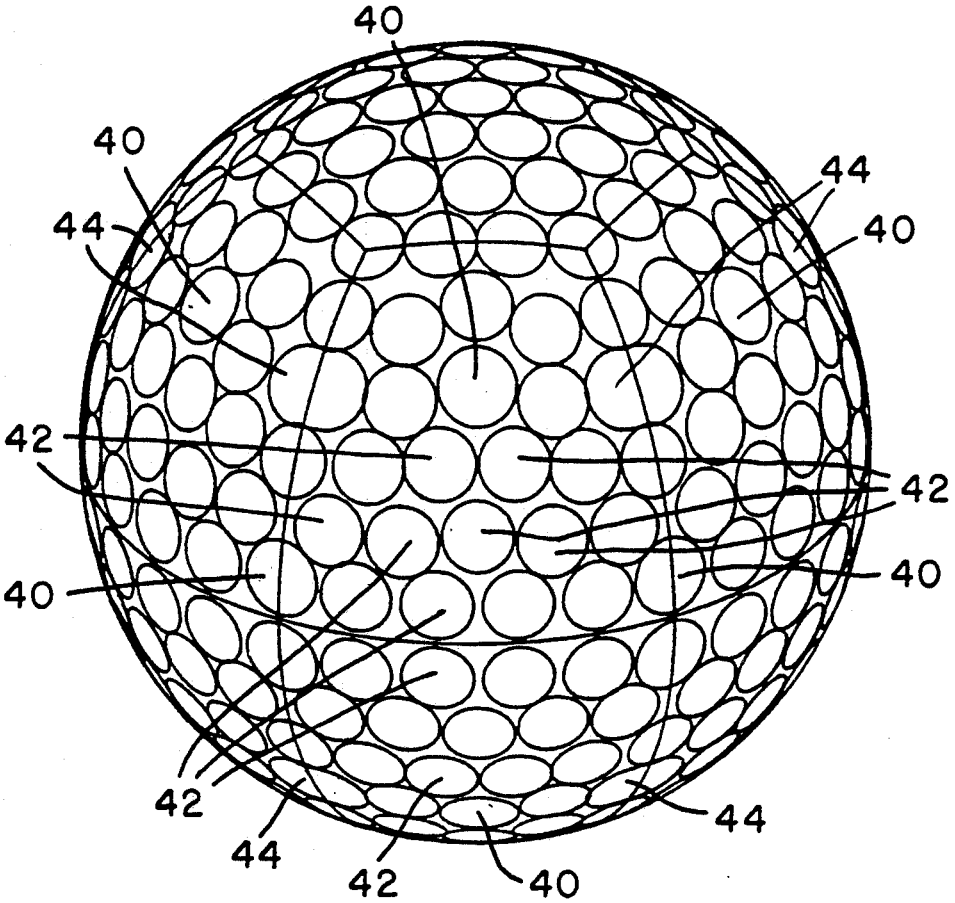
FIG. 8 shows another arrangement of dimples in the pattern of FIG. 3 with one parting line.

In the dimple arrangement in FIG. 8, there is but a single parting line, the equator 16, as there is in the embodiment of FIG. 7. However, unlike the embodiment of FIG. 7, the dimple pattern in FIG. 8 has dimples which intersect the sides of each of the hexagons and trapezoids. As illustrated, and as preferred in this embodiment, the dimples along the sides of the hexagons and trapezoids are bisected by the sides of the hexagons and trapezoids. The embodiment of FIG. 8 also shows dimples of varying diameters and dimples of non-circular shape. For example, dimples 40 are of larger diameter than dimples 42. Dimples 44, which are bisected by the sides of the trapezoid, are not circular in shape but, rather, have the shape of a "racetrack." Other dimple shapes, notably triangles, can also be employed, if desired.

In the best mode contemplated for the present invention, 252 dimples are laid out substantially as shown in the embodiment of FIG. 6, i.e. six of the ten great circle paths of FIG. 3 are intersected by dimples and the other four great circle paths are not intersected by dimples and are, thus, parting lines. The dimples are all of substantially the same size and have a nominal dimple diameter of 0.17 inch and a nominal dimple depth of 0.01 inch. Dimple diameter in the present invention is measured according to the teaching of U.S. Pat. No. 4,936,587, the relevant parts of which are incorporated herein by reference, especially FIGS. 3–5 and the portions of the specification that relate thereto. Dimple depth according to the present invention is measured similarly to FIGS. 14–18 of U.S. Pat. No. 4,936,587 which, along with the relevant portions of the specification, is also incorporated herein by reference. In accordance with the instant invention, depth is measured from the chord line 168 of FIG. 18 of the '587 patent rather than from the line 41 which is the continuation of the periphery of the golf ball.

It will be understood that the claims are intended to cover all changes and modifications of the preferred embodiments of the invention herein chosen for the purpose of illustration which do not constitute a departure from the spirit and scope of the invention.

What is claimed is:

1. A golf ball having an equator (16) which is a great circle path about said golf ball, said great circle path being defined as a circle on the surface of the ball formed by a plane which passes through the center of the ball, and first and second poles (14) on the surface of the golf ball, the poles being the points where a line perpendicular to the said plane of the ball and which passes through the center of the ball intersects the surface of the golf ball, and said golf ball having a plurality of dimples on the surface thereof, said dimples being distributed on the surface of the golf ball according to the configuration of a tetrakaidecahedron projected onto the surface of the golf ball, said projected tetrakaidecahedron comprising two spherical hexagons (10) and twelve spherical trapezoids (12), one said spherical hexagon (10) having as its center point the first pole (14) and the other said spherical hexagon having as its center point the second pole (14), the legs (24) of each hexagon (10) serving as a top (24) of each spherical trapezoid (12) and a section of the equator (16) serving as a base of each spherical trapezoid (12), each of the sides (18) of each of the spherical trapezoids (12) extending from a vertex of the spherical hexagon (10) to the equator (16), all said spherical trapezoid sides (18) being equal in length and each said spherical trapezoid (12) having the shape of a truncated spherical isosceles triangle, and said dimples being symmetrically positioned on the surface of the golf ball to correspond to the layout of the hexagons and trapezoids of the said tetrakaidecahedron projected onto the surface of the ball.

2. The golf ball of claim 1 wherein each said spherical hexagon is subdivided into spherical triangles formed by three spherical diagonals extending from opposed vertices and passing through the pole and wherein at least some of said spherical trapezoids are subdivided into spherical triangles by spherical diagonals extending from opposed vertices and wherein there are sufficient spherical diagonals extending from opposed vertices in the spherical trapezoids to form a great circle path with at least some of the sides of the spherical hexagon.

3. The golf ball of claim 1 wherein there are no dimples which intersect the equator, the sides of the spherical hexagon, or the sides of the spherical trapezoids.

4. The golf ball of claim 1 wherein each said spherical hexagon is subdivided into spherical triangles formed by three spherical diagonals extending from opposed vertices and passing through the pole, said spherical diagonals forming great circle paths with the spherical trapezoid sides which extend from the vertices of the spherical diagonal.

5. A golf ball having an equator (16) which is a great circle path about said golf ball, said great circle path being defined as a circle on the surface of the ball formed by a plane which passes through the center of the ball, and first and second poles (14) on the surface of the golf ball, the poles being the points where the axis of a line perpendicular to the said plane of the ball and which passes through the center of the ball intersects the surface of the golf ball, and said golf ball having a plurality of dimples on the surface thereof, said dimples being distributed on the surface of the golf ball according to the configuration of a tetrakaidecahedron projected onto the surface of the golf ball, said projected tetrakaidecahedron comprising two spherical hexagons (10) and twelve spherical trapezoids (12), one said spherical hexagon (10) having as its center point the first pole (14) and the other said spherical hexagon having as its center point the second pole (14), the legs (24) of each hexagon (10) serving as a top (24) of each spherical trapezoid (12) and a section of the equator (16) serving as a base of each spherical trapezoid (12), each of the sides (18) of each of the spherical trapezoids (12) extending from a vertex of the spherical hexagon (10) to the equator (16), all said spherical trapezoid sides (18) being equal in length and each said spherical trapezoid (12) having the shape of a truncated spherical isosceles triangle, each said spherical hexagon being subdivided into spherical triangles formed by three spherical diagonals extending from opposed vertices and passing through the pole, said spherical diagonals forming three great circle paths with the spherical trapezoid sides which extend from the vertices of the spherical diagonal, said spherical trapezoids being subdivided into spherical triangles by spherical diagonals extending from opposed vertices, said spherical triangles in combination with the sides of the spherical hexagons forming six great circle paths, whereby a total of ten great circle paths, including the great circle path at the equator, are formed and said dimples being symmetrically positioned on the surface of the golf ball to correspond to the layout of the said ten great circle paths derived from the tetrakaidecahedron projected onto the surface of the golf ball.

6. The golf ball of claim 5 wherein at least some of said spherical trapezoids are subdivided into spherical triangles by spherical diagonals extending from opposed vertices.

7. The golf ball of claim 6 wherein spherical diagonals extending from opposed vertices are present in all of the spherical trapezoids whereby, in combination with the sides of the spherical hexagons, the sides of the spherical trapezoids, the spherical diagonals of the spherical hexagon and the equator, a total of ten great circle paths is formed.

8. The golf ball of claim 5 wherein the dimples on the surface of the golf ball are arranged so that they do not intersect any of the said ten great circle paths.

9. The golf ball of claim 5 wherein the dimples are arranged so that they intersect three of the great circle paths but so that they do not intersect the other seven great circle paths.

10. The golf ball of claim 5 wherein the dimples are arranged so that they intersect six of said great circle paths but do not intersect the other four of said great circle paths.

11. The golf ball of claim 5 wherein the dimples are arranged so that there is only one great circle path which is not intersected by any dimples.

12. The golf ball of claim 5 wherein there are dimples of at least two different shapes.

13. The golf ball of claim 5 wherein there are dimples of at least two different diameters.

14. The golf ball of claim 5 wherein at least some of the dimples are non-circular.

15. The golf ball of claim 1 wherein there are dimples of at least two different shapes.

16. The golf ball of claim 1 wherein there are dimples of at least two different diameters 17. The golf ball of claim 1 wherein at least some of the dimples are non-circular.

* * * * *